US005092618A

United States Patent [19]

Mayr

[11] Patent Number: 5,092,618

[45] Date of Patent: Mar. 3, 1992

[54] SKI COMPRISING DAMPING LAYERS

[75] Inventor: Bernhard Mayr, Hard, Austria

[73] Assignee: Head Sportgeraete Gesellschaft m.b.h & Co. OHG, Kennelbach, Austria

[21] Appl. No.: 351,202

[22] Filed: May 15, 1989

[30] Foreign Application Priority Data

May 26, 1988 [AT] Austria ..... 1386/88

[51] Int. Cl.[5] ..... A63C 5/07

[52] U.S. Cl. ..... 280/602; 280/610

[58] Field of Search ..... 280/608, 610, 602, 601, 280/609

[56] References Cited

U.S. PATENT DOCUMENTS

| | | | |
|---|---|---|---|
| 2,995,379 | 8/1961 | Head | 280/610 |
| 3,582,098 | 6/1971 | Michal | 280/608 |
| 4,293,142 | 10/1981 | Davignon | 280/610 |
| 4,412,687 | 11/1983 | Andre | 280/610 |
| 4,627,635 | 12/1986 | Koleda | 280/610 X |
| 4,848,784 | 7/1989 | Scherübl | 280/608 X |

FOREIGN PATENT DOCUMENTS 1580326 9/1969 France .

*Primary Examiner*—Andres Kashnikow
*Assistant Examiner*—Michael Mar
*Attorney, Agent, or Firm*—Nixon & Vanderhye

[57] ABSTRACT

A multi-layered ski includes an upper strap disposed over at least a part of the length of the ski, a core, and a running surface, with the core disposed between the upper strap and the running surface. The upper strap is constructed so as to attenuate low frequency vibrations, without reduction in the torsional stiffness of the ski, thereby enhancing the running properties of the ski. The upper strap includes a top layer, and a layer of damping material (e.g. an elastomeric synthetic plastic having a modulus of elasticity of about $10^7$–$10^{10}$ Pa, and a dissipation factor tan δ greater than 0.8). The damping layer is just below the top layer. At least one lower laminating layer is also provided, below the damping layer. At least one slot is formed in the top layer transverse to the dimension of elongation of the ski and separating portions of the top layer from each other in the dimension of elongation. The lower laminating layer overlaps the slots in the dimension of elongation.

28 Claims, 1 Drawing Sheet

SKI COMPRISING DAMPING LAYERS

BACKGROUND OF THE INVENTION

1. Field of the Invention

The invention refers to a multilayer ski comprising an upper strap, which consists over at least part of the length of the ski of at least two layers being connected one with the other with interposition of a visco-elastic or viscous damping layer, a core and a running surface.

2. Description of the Prior Art

Multilayer skis comprising laminated materials being connected one with the other in a laminar manner have, when being rigidly glued, a good torsion stiffness with simultaneous good strength properties and bending properties. A ski of this type, in which the upper strap consists over the whole length of the ski of two metallic layers being connected one with the other with a sandwiched elastic layer is shown in U.S. Pat. No. 2,995,379. The fact that skis shall, on the one hand, show torsion stiffness and, on the other hand, shall also show bending elasticity results in differing requirements with respect to the load carrying capacity of the composite construction along different axes, and a full-areal glueing of individual layers as in present multilayer skis is, when it is intended to reliably provide for a corresponding torsion stiffness, are unsuitable to attenuate vibrations, in particular transversal vibrations.

SUMMARY OF THE INVENTION

The invention now aims at providing a multilayer ski which provides better attenuation of the low-frequency vibrations of the skis detracting from the running properties, and thus seek to provide a multilayer ski having improved running properties.

The problem of attenuation of low frequency vibrations is solved according to the present invention by providing discontinuities in the top layer of the upper strap of the ski, so that portions of the top layer are separated from each other in the dimension of elongation. However the desired torsional stiffness of the ski is not sacrificed by such construction since at least one lower laminating layer is disposed below the damping layer of the upper strap, the lower laminating layer providing desired torsional stiffness. The construction according to the invention is capable of attenuating low frequency oscillations, particularly oscillations within the range of 15–150 Hz, preventing transfer of the oscillations from the ski to the bindings.

A particular construction of multi-layered ski (having a dimension of elongation) according to the invention is as follows: An upper strap disposed over at least a part of the length of the ski, the upper strap comprising a top layer, a damping layer just below the top layer, and at least one lower laminating layer below the damping layer. Means defining at least one slot in the top layer extending substantially perpendicular to the dimension of elongation, and completely separating portions at the top layer rom each other in the dimension of elongation. At least one lower laminating layer overlapping the slot in the dimension of elongation; and a core and a running surface, the core disposed between the upper strap and the running surface.

The lower laminated layer preferably comprises an aluminum layer or a fiber reinforced laminated synthetic plastic material. Such materials provide sufficient break strength and torsional stiffness. The top layer of the upper strap may comprise aluminum or steel or various plastic composites including reinforcements by glass fibers, carbon fiber, aramide fibers, or boron fibers. Also, a conventional covering coating is provided, which is only of minor importance for the strength properties and torsional stiffness of the ski but which is typically applied to the top layer.

Advantageously, the arrangement is, according to the invention, selected such that the visco-elastic or viscous intermediate damping layer consists of an elastomeric synthetic plastics material having a modulus of elasticity of $10^7$ to $10^{10}$ Pa, preferably approximately $10^8$ Pa, and a dissipation factor tan $\delta > 0.8$, preferably a tan $\delta$ of approximately 1.5. Such a material, being in particular a rubber-elastic material, having a modulus of elasticity between $10^7$ and $10^{10}$ Pa and having the indicated dissipation factor differs substantially from hard rubber layers already used in ski constructions and is capable to attenuate in an optimum manner frequencies between 15 and 150 Hz within a temperature range of −35° C. to +10° C. For the purpose to introduce into the visco-elastic damping layer consisting of such a material the shearing forces, the arrangement is advantageously selected such that the visco-elastic or viscous layer has a thickness of 0.3 to 2.5 mm, preferably 0.7 to 1.3 mm.

For the purpose of maintaining the advantages resulting from designing such an attenuating member in the shape of a structure comprising three layers and an outer slotted layer irrespective by arrangements of parts of ski bindings, the arrangement is, according to the invention, selected such that the outer layer, which has at least one cross section, has, within the area of the binding parts, perforations or, respectively, elongated holes extending in longitudinal direction of the ski and receiving mounting screws or bolts for the binding parts. Such elongated holes or, respectively, perforations extending in longitudinal direction of the ski, allow to slidably fix binding parts on the inner load-carrying parts of a ski and do not obstruct the introduction of shearing forces into the visco-elastic layer and the shifting movement of the upper laminated material. For the purpose of completely decoupling the outer layer from the inner layer, the arrangement is, when mounting the binding parts, advantageously selected such that the binding parts are connected to the outer layer of the ski with interposition of a sliding layer or under the formation of an air gap.

The slot or slots provided in the outer layer and extending in transverse relation to the longitudinal direction of the ski shall reliably provide for an unobstructed transmission of shearing forces, which are generated in case of oscillations of the ski and, respectively, when bending the ski, onto the visco-elastic damping layer, for which purpose the arrangement is advantageously selected such that the transverse slot or slots of the outer layer extend(s) till the lateral edge of the ski. For the purpose of attenuating oscillations in a particularly efficient manner and independent from the direction, the arrangement is selected preferably such that the transverse slot(s) of the outer layer extend(s) without interruption over the whole width of the outer layer.

Advantageously, the slot or slots extending in transverse relation to the longitudinal direction of the ski are, in this case, arranged in an oscillation node of the oscillations of the ski, so that there result optimum damping properties. The slots can be arranged over the whole length of the ski. The location of the oscillation nodes depends on the type (mode) of the natural oscillation (fundamental oscillation, 1st, 2nd, 3rd, . . . harmonic oscillation). The natural oscillation itself depends in its turn on the stiffness, the stiffness distribution, the weight distribution, the clamping and so on of the ski. In dependence on the intended use of the ski, different natural oscillations of the ski can be excited, some of these oscillating frequencies possibly having a disturbing influence on the running properties of the ski. These disturbing oscillations are attenuated in an optimum manner by arranging slots at the location of their oscillation nodes.

The attenuating property of the visco-elastic or viscous intermediate layer is influenced by the thickness of the intermediate layer, the length and the width of the intermediate layer, the location on the ski as well as the number of damping members on the ski and can thus be adjusted within broad limits according to the requirements.

According to a preferred embodiment, the arrangement is selected such that the width of the slot or slots in longitudinal direction of the ski is (are) 0.7 to 2.5 mm, preferably approximately 1.5 mm, thus taking in consideration the occurring maximum shifting movements. For further improving the damping properties, the procedure is preferably such that the slot(s) is (are) filled by a attenuating material, attenuation being effected by deforming under pressure the attenuating material within the slot.

BRIEF DESCRIPTION OF THE DRAWING

In the following, the invention is further explained with reference to an example of embodiment schematically shown in the drawing.

In the drawing.

DETAILED DESCRIPTION OF THE PREFERRED EMBODIMENT

Figure 1:
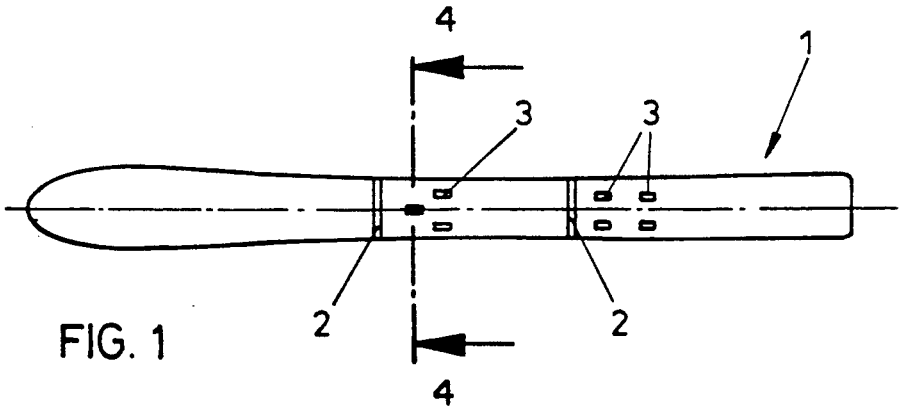
FIG. 1 shows a top plan view of an exemplary ski according to the invention.

In FIG. 1, there is schematically shown an inventive ski 1 having transverse slots 2 extending over the whole width of the ski and in transverse relation to the longitudinal direction of the ski. Several elongated holes 3 are provided in the ski surface for receiving mounting screws or bolts for the binding parts 4.

Figure 2:
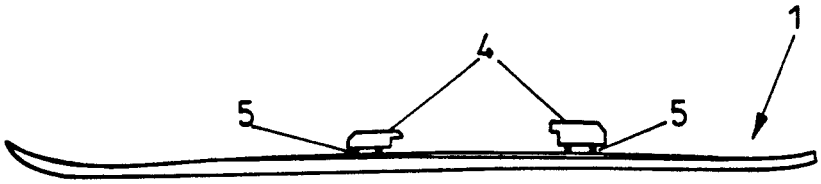
FIG. 2 shows a side elevation of the ski having the binding mounted thereon.

In FIG. 2, there is shown a side elevation of the ski 1 according to the invention, said side elevation schematically showing the mounting of the binding 4 within the elongated holes 3 provided in the ski surface. The binding parts 4 are fixed to the internal load-carrying parts of the ski 1 via the elongated holes 3 and with the formation of an air gap 5, so that introduction of shearing forces into the damping layer of the ski is not obstructed by the mounted binding parts.

Figure 3:
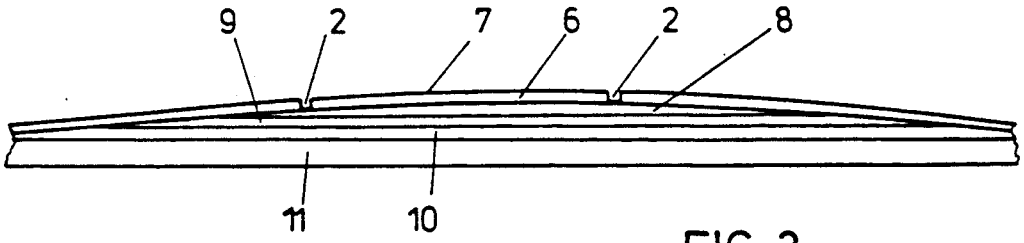
FIG. 3 shows a detail of FIG. 2 in an enlarged scale.

FIG. 3 shows the multi-layer construction of the upper strap and, respectively, of the underlying damping layers of the ski. The outer layer 6 of the upper strap being formed of aluminum or steel or thermo-composites and/or duroplastic composites being reinforced by glass fibres, carbon fibres, aramide fibres, boron fibres has, like the overlying usual cover layer 7 of the ski, slots 2 transversally extending over the whole width of the ski. These slots 2 are, with interposition of a visco-elastic damping layer 8, overlapped by a further layer being formed of aluminum or a fibre-reinforced laminated synthetic plastics material 9. A further layer 10 formed of such materials is located beneath said layer 9 formed of aluminum or fibre-reinforced laminated synthetic plastics material and extends over the whole length of the ski. On account of this construction, there are formed at least two relatively stable load distributing layers which are capable of receiving shearing forces. The ski core itself is designated by the reference numeral 11 in FIG. 3.

Figure 4:
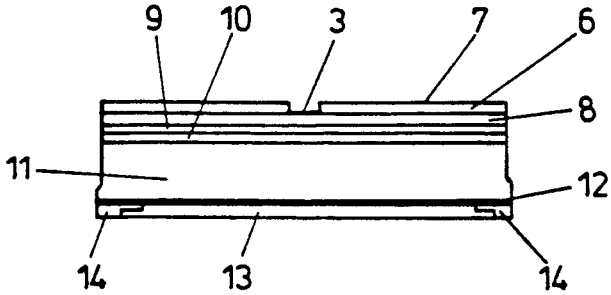
FIG. 4 shows a section along line IV—IV of FIG. 1 of another embodiment.

In FIG. 4, there is shown a cross section through another embodiment of the ski according to the invention. In this embodiment, the outer layer is again designated by 6 and the overlying usual cover layer of the ski is designated by 7. In this embodiment the layer 6 is interrupted by an elongated hole 3 receiving bolts or screws, respectively, for mounting the binding. Below said outer slotted layer 6, there is again located a visco-elastic damping layer 8 which shall absorb, in particular, the low-frequency oscillations generated during skiing. The second aluminum layer and the layer formed of fibre-reinforced laminated synthetic plastics material and overlapping the elongated holes and the transverse slots in the layer 6, respectively, as well as the underlying layer extending over the whole length of the ski and being formed of the same material or an other material than that forming the slotted laminated material are again designated by 9 and 10 in FIG. 4. Below the ski core 11, there is located the bottom strap 12 of the ski being equally formed of aluminum or fibre-reinforced laminated synthetic plastics material. A running surface 13 as well as steel edges 14 are arranged on this bottom strap 12, which is equally capable to receive shearing forces.

What is claimed is:

1. A multi-layered ski having a longitudinal dimension of elongation, comprising: 'an upper strap disposed over at least a part of the length of the ski;

said upper strap comprising: a top outer layer, a visco-elastic or viscous damping layer extending just below said top outer layer, and at least one lower laminating layer below said damping layer;

means defining at least one slot in said top outer layer extending across the entire width of said top outer layer in a direction substantially perpendicular to said longitudinal dimension of elongation, and completely separating portions of said top outer layer from each other in said longitudinal dimension of elongation;

said at least one lower laminating layer extending below said slot in said longitudinal dimension of elongation; and a core and a running surface, said core disposed between said upper strap and said running surface.

2. A ski as recited in claim 1 further comprising a continuous laminated material disposed between said upper strap and said core, said continuous laminated material selected from the group consisting essentially of aluminum and a fiber-reinforced laminated synthetic plastics material.

3. A ski as recited in claim 1 wherein said top outer layer comprises a layer of material selected from the group consisting essentially of aluminum, steel, and a plastic including reinforcing glass fibers, carbon fibers, aramide fibers, or boron fibers.

4. A ski as recited in claim 3 wherein said top outer layer has a top surface, and further comprises a cover layer disposed on said top surface and interrupted at said at least one slot.

5. A ski as recited in claim 1 wherein said at least one slot comprises a plurality of slots.

6. A ski as recited in claim 1 wherein said at least one slot comprises two slots.

7. A ski as recited in claim 6 wherein each slot has a dimension in the longitudinal dimension of elongation of the ski of about 0.5–2.55 mm.

8. A ski as recited in claim 1 further comprising means defining first and second sets of elongated holes in said top outer layer, for receipt of ski bindings; and wherein one of said slots is disposed between said sets of holes, and the other slot is forward of said sets of holes in the longitudinal dimension of elongation of said ski.

9. A ski as recited in claim 8 further comprising binding elements connected to said top outer layer, with a sliding layer or under formation of an air gap disposed between said binding parts and said top outer layer.

10. A ski as recited in claim 1 wherein said at least one lower laminating layer below said damping layer comprises a layer of material selected from the group consisting essentially of aluminum and fiber reinforced laminated synthetic plastic material.

11. A ski as recited in claim 1 wherein said damping layer comprises an elastomeric synthetic plastic material having a modulus of elasticity of $10^7$ to $10^{10}$ Pa, and a dissipation factor tan $\delta$ of greater than 0.8.

12. A ski as recited in claim 11 wherein the modulus of elasticity is approximately $10^8$ Pa, and the dissipation factor is tan $\delta$ of approximately 1.5.

13. A ski as recited in claim 1 wherein said damping layer has a thickness of about 0.3–2.5 mm.

14. A ski as recited in claim 13 wherein said damping layer has a thickness of about 0.7–1.3 mm.

15. A ski as recited in claim 1 having a pair of spaced lateral edges parallel to the dimension of elongation thereof, and wherein each slot in the top layer extends completely from one lateral edge to the other.

16. A ski as recited in claim 15 wherein each slot is disposed at a position along the dimension of elongation of the ski corresponding to an oscillation node of the ski.

17. A ski as recited in claim 5 wherein said at least one slot comprises two slots.

18. A ski as recited in claim 17 further comprising means defining first and second sets of elongated holes in said top outer layer, for receipt of ski bindings; and wherein one of said slots is disposed between said sets of holes, and the other slot is forward of said sets of holes in the longitudinal dimension of elongation of said ski.

19. A ski as recited in claim 17 wherein each slot is disposed at a position along the dimension of elongation of the ski corresponding to an oscillation node of the ski.

20. A ski as recited in claim 1 wherein each slot has a dimension in the longitudinal dimension of elongation of the ski of about 0.5–2.55 mm.

21. A ski as recited in claim 20 wherein each slot has a dimension in the longitudinal dimension of elongation of the ski of about 1.5 mm.

22. A ski as recited in claim 1 wherein each slot is filled with a damping material.

23. A ski as recited in claim 1 wherein each slot is disposed at a position along the longitudinal dimension of elongation of the ski corresponding to an oscillation node of the ski.

24. A multi-layered ski having a longitudinal dimension of elongation, comprising:

an upper strap disposed over at least a part of the length of the ski;

said upper strap comprising: a top outer layer, and a visco-elastic or viscous damping layer extending just below said top outer layer;

means for improving the ability of the ski to attenuate low frequency vibrations without reduction in torsional stiffness, thereby enhancing the running properties of the ski, said means comprising: means for defining at least one slot extending across the entire width of said top outer layer in a direction transverse to the longitudinal dimension of elongation of said ski in so that portions of said top outer layer are completely spaced from each other in the longitudinal dimension of elongation of the ski; and at least one lower laminating layer extending below said damping layer, and extending below said at least one slot in the longitudinal dimension of elongation of the ski, for providing torsional stiffness; and a core and a running surface, said core disposed between said lower layer of said upper strap and said running surface.

25. A ski as recited in claim 24 further comprising a continuous laminated material disposed between said upper strap and said core, said continuous laminated material selected from the group consisting essentially of aluminum and a fiber-reinforced laminated synthetic plastics material.

26. A ski as recited in claim 24 wherein each slot is disposed at a position along the longitudinal dimension of elongation of the ski corresponding to an oscillating node of the ski.

27. A ski as recited in claim 24 wherein said at least one slot comprises two slots.

28. A ski as recited in claim 24 further comprising means defining first and second sets of elongated holes in said top outer layer, for receipt of ski bindings; and wherein one of said slots is disposed between said sets of holes, and the other slot is forward of said sets of holes in the longitudinal dimension of elongation of said ski.

* * * * *